US006011572A

United States Patent [19]

Osakama et al.

[11] Patent Number: 6,011,572

[45] Date of Patent: Jan. 4, 2000

[54] HEAD UP-DOWN MECHANISM IN PRINTER

[75] Inventors: Chikashi Osakama; Jun Taniguchi, both of Iwate-ken, Japan

[73] Assignee: Alps Electric Co., Ltd., Tokyo, Japan

[21] Appl. No.: 09/208,515

[22] Filed: Dec. 9, 1998

[30] Foreign Application Priority Data

Dec. 19, 1997 [JP] Japan ..... 9-350916

[51] Int. Cl.[7] ..... B41J 25/304

[52] U.S. Cl. ..... 347/197

[58] Field of Search ..... 347/197; 400/120.16

[56] References Cited

U.S. PATENT DOCUMENTS 5,672,017 9/1997 Taniguchi .

5,801,744 9/1998 Taniguchi et al. ..... 347/197

*Primary Examiner*—Huan Tran

*Attorney, Agent, or Firm*—Brinks Hofer Gilson & Lione

[57] ABSTRACT

A head up-down mechanism in a printer is to be provided wherein, by a simple construction, a carriage is returned up to a printing start position while a thermal head is spaced apart from a platen and at the same time there is performed a paper feed operation and which can thereby improve an effective printing speed. To this end the head up-down mechanism includes a head up-down lever with a thermal head mounted thereon at a position opposed to a platen, the head up-down lever being supported pivotably by a carriage which reciprocates along the platen between both side plates spaced a predetermined distance from each other, an urging member for urging the head up-down lever in a direction in which the thermal head comes into abutment against the platen, and a head up-down cam which is moved by abutment thereof against each of the side plates and which causes the head up-down lever to turn so that the thermal head comes into or out of contact with the platen.

4 Claims, 4 Drawing Sheets

HEAD UP-DOWN MECHANISM IN PRINTER

BACKGROUND OF THE INVENTION

1. Field of the Invention

The present invention relates to a head up-down mechanism in a printer for moving a thermal head into and out of contact with a platen of the printer for printing on a printing paper such as a thermal paper. Particularly, the invention is concerned with a head up-down mechanism in a printer suitable as an output device for a portable personal computer or the like.

2. Description of the Prior Art

Recently, as an output device for a portable personal computer or the like there has been used a small-sized thermal printer which makes printing directly on a printing medium with use of a thermal head. Such a thermal printer is required to be small-sized and is improved in performance while retaining a low cost. Particularly, a thermal head up-down mechanism is required to be an efficient mechanism because it exerts an influence on the printing speed in relation to the feed of printing paper.

Reference will be made below to a conventional thermal printer 24 having a head up-down mechanism.

In the conventional thermal printer 24, as shown in FIGS. 7 and 8, a back frame 26 located on a back side is formed with a platen mounting portion 28 for mounting a platen 27. At a lower position on the front side of the platen mounting portion 28 is disposed a support shaft 30 for supporting a carriage 29, the support shaft 30 being supported by side frames 31L and 31R in parallel with the platen 27. The carriage 29 is fitted on the support shaft 30 so that it can reciprocate along the platen 27.

On the front side of the support shaft 30 and in proximity thereto is disposed a carriage driving shaft 32 for driving the carriage 29, the carriage driving shaft 32 being supported rotatably by the side frames 31L and 31R and in parallel with the platen 27. A worm 33 for engagement with the carriage 29 is slidably splined to the carriage driving shaft 32. On a base frame 34 of the thermal printer 24 is disposed a rack plate 35, in parallel with the carriage driving shaft 32, the rack plate 35 having rack teeth 35*a* for mesh with the worm 33. To both ends of the carriage driving shaft 32 are connected power transfer gears 36, and driving gears 37*a* of a drive motor 37 are in mesh with the power transfer gears 36, so that a rotative driving force of the drive motor 37 is transmitted as a rotating force to the carriage driving shaft 32.

A worm fitting portion 39 for fitting therein of the worm 33 is formed in a concave shape in the lower edge portion of the carriage 29 and at a position close to the center thereof. Further, on the platen 27 side, two support portions 41 are projectingly provided on both lower corner portions of the carriage 29. The support portions 41 each have an insertion hole 40 for insertion therethrough of the support shaft 30.

According to this construction, with movement of the worm 33 on the carriage driving shaft 32, the carriage 29 moves while being supported by the support shaft 30.

On the platen 27 side, a fitting hole (not shown) is formed in an upper portion of the carriage 29, and one end portion of a coiled spring 42, which functions as an urging member for urging the thermal head 25 to the platen 27 side, is fitted in the fitting hole.

Between the carriage 29 and the platen 27, a flat plate-like thermal head mounting base 44 for mounting the thermal head 25 is fitted on the support shaft 30 pivotably between the support portions 41 of the carriage 29. The thermal head 25 is secured to the thermal head mounting base 44 at a position opposed to the platen 27, while in the side face on the carriage 29 side of the thermal head mounting base 44 is formed a fitting hole 45 for fitting therein of the opposite end portion of the coiled spring 42. With the urging force of the coiled spring 42, the thermal head mounting base 44 is turned about the support shaft 30, causing the thermal head 25 to come into pressure contact with the platen 27.

On the other hand, convex cam portions 48*a* and 48*b* are formed at both ends of the platen mounting portion 28 and at positions outside a printable area of the thermal head 25. The cam portions 48*a* and 48*b* project from the platen 27 side toward the carriage 29 side. The cam portions 48*a* and 48*b* respectively have front edges 46*a* and 46*b* in parallel with the moving direction of the carriage 29 and also have slant faces 47*a* and 47*b* which are inclined in the moving direction of the carriage 29 from the front edges 46*a* and 46*b* toward both end portions of the platen 27.

Consequently, when the thermal head 25 has moved beyond its printable area, the thermal head mounting portion 44, with movement of the carriage 29, moves along the slant faces 12*a* and 12*b* of the cam portions 13*a* and 13*b* against the urging force of the coiled spring 42 and causes the thermal head 25 to move away from the platen 27.

Now, a description will be given below of the operation of the conventional thermal printer 24 having the head up-down mechanism of the above construction.

When the driving force of the drive motor 37 is transmitted to the carriage driving shaft 32 through the power transfer gears 36. and causes the shaft 32 to rotate, the worm 33 starts rotating. Since the worm 33 is in mesh with the rack teeth 35*a* formed on the rack plate 35, it moves along the rack plate 35, and with this movement of the worm 33, the carriage 29 moves along the platen 27 while being supported by the support shaft 30.

Further, since the thermal head mounting base 44 is urged at all times toward the platen 27 by virtue of the coiled spring 42, the thermal head 25 secured to the thermal head mounting base 44 is brought into pressure contact with the platen 27 through a printing paper such as a thermal paper.

The thermal head 25, in its printable area, causes heat generating elements (not shown) to generate heat in accordance with a predetermined printing command issued from a control means (not shown), allowing printing to be performed for one line on the printing paper.

After this printing, when the carriage 29 moves as it is and goes beyond the printable area of the thermal head 25, the thermal head mounting base 44, with this movement of the carriage 29, moves up along the slant faces 47*a* and 47*b* of the cam portions 48*a* and 48*b* while turning toward the carriage 29 against the coiled spring 42, causing the thermal head 25 to be spaced away from the platen 27.

When the thermal head mounting base 44 goes up to the front edges 46*a* and 46*b* of the cam portions 13*a* and 13*b*, the carriage 29 stops and the printing paper is fed one line by means of a conveyance roller (not shown).

Once this paper feed is done, the drive motor 37 rotates in the opposite direction and this rotative driving force is transmitted to the carriage driving shaft 32 through the power transfer gears 36, whereupon the shaft 32 also starts rotating in the opposite direction and moves the carriage 29 in the opposite direction. In this way the same printing operation as above is repeated until a desired printing is completed.

Thus, in the conventional thermal printer 24 having the head up-down mechanism of the above construction, printing can be done by movements in two directions of the carriage 29, so that the effective printing speed can be improved.

In the thermal printer 24, however, there sometimes occurs a case where printing dot-formed positions become out of register due to the different moving directions of the carriage 29 and hence printing is not effected in a satisfactory manner.

According to the method adopted therein for solving such a problem, an energized position of the thermal head 25 is modified in accordance with a moving direction of the carriage 29 to thereby prevent the positional deviation of printing dots.

However, even with such correction of the energized position of the thermal head, it is difficult to make dot positions coincident completely in the bi-directional printing In a printer for a personal computer or the like requiring description of graphics, it is the usual way of doing that printing is performed in only one direction.

In this connection, when printing is performed in one direction by means of the conventional thermal printer 24 having the head up-down mechanism of the above construction, and at the time of insertion of printing paper or for paper feed after one-line printing, it is necessary that the thermal head 25 be allowed to strike on the cam portions formed at both ends of the platen 27 and be allowed to stand by in a head-up state.

More particularly, if one-way printing is conducted by means of the head up-down mechanism of the conventional thermal head 24 and where paper feed is done after printing, the paper feed is sure to be done after return to the stand-by position, so that the procedure of printing, carriage return, paper feed, and printing is repeated and it is impossible to conduct both paper feed and carriage return at a time, thus giving rise to the inconvenience that the effective printing speed decreases.

SUMMARY OF THE INVENTION

It is an object of the present invention to provide a head up-down mechanism in a printer which, with a simple construction, permits a carriage to be returned to a printing start position while a thermal head is kept spaced away from a platen and which permits a paper feed operation to be done at the same time, thereby making it possible to improve the effective printing speed.

According to the present invention, in order to achieve the above-mentioned object, there is provided in one aspect thereof a head up-down mechanism in a printer, comprising a carriage capable of reciprocating along a platen between both side plates which are spaced a predetermined distance from each other, a head up-down lever supported pivotably by the carriage and with a thermal head mounted thereon at a position opposed to the platen, an urging member for urging the head up-down lever in a direction in which the thermal head abuts the platen, and a head up-down cam which is moved by abutment thereof against each of the side plates. According to this construction, by merely bringing the head up-down cam into abutment against each side plate, the carriage can be moved up to the printing start position while the thermal head is kept spaced away from the platen and at the same time it is possible to effect a paper feed operation, whereby the effective printing speed can be improved.

Moreover, by bringing the head up-down cam into abutment against one of the side plates as the carriage reciprocates, thereby causing the cam to move in the direction opposite to the moving direction of the carriage, a mere reciprocation of the carriage suffices to move the thermal head into or out of contact with the platen.

Further, by forming on the head up-down cam an inclined cam surface for change-over between a contacting motion and a leaving motion of the thermal head with respect to the platen and a flat cam surface for maintaining the thermal head spaced apart from the platen, it becomes possible to bring the thermal head into or out of contact with the platen easily and smoothly and the thermal head can surely be kept spaced away from the platen.

Further, by forming on the head up-down lever a cam sliding portion for sliding on the inclined cam surface and the flat cam surface of the head up-down cam, the pivotal motion of the head up-down lever is performed with sliding motion of the cam sliding portion and hence the contacting and leaving motions of the thermal head can be done more smoothly.

DETAILED DESCRIPTION OF THE PREFERRED EMBODIMENT

Figure 1:
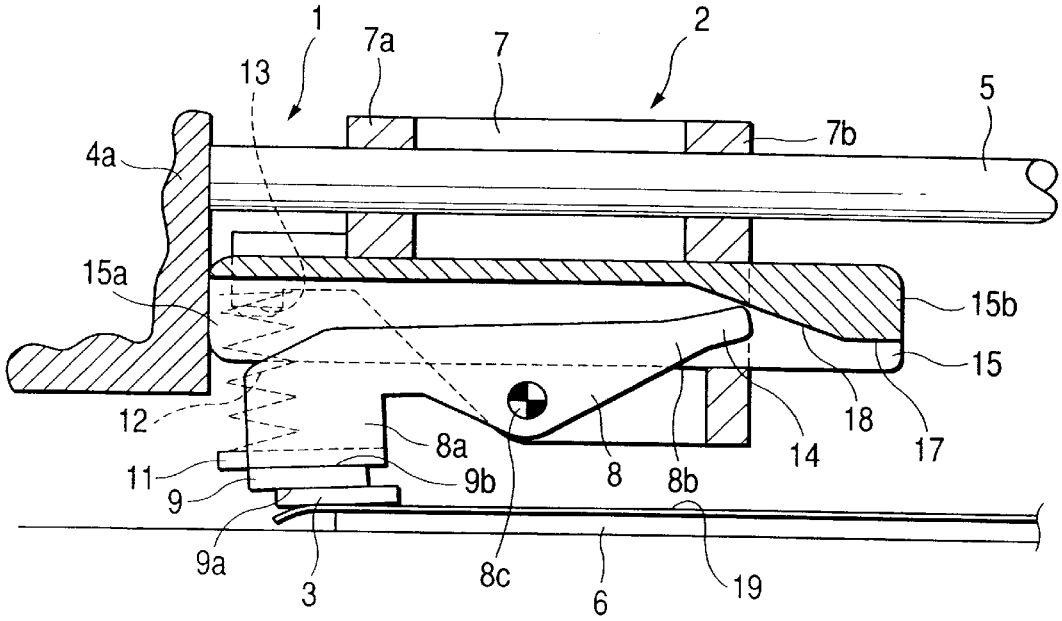
FIG. 1 is a plan view showing a head up-down mechanism used in a printer according to an embodiment of the present invention.

FIG. 1 is a plan view showing a head up-down mechanism used in a printer according to an embodiment of the present invention and FIGS. 2 to 6 are explanatory views showing head up-down motions of a thermal head 3 used in the embodiment.

In a head up-down mechanism 2 used in a thermal printer 1 of this embodiment, a carriage guide shaft 5 is mounted to both side plates 4*a* and 4*b* of the thermal printer 1 in parallel with a platen 6, the side plates 4*a* and 4*b* being spaced a predetermined distance from each other. A carriage 7 is slidably held on the carriage guide shaft 5.

Of the side plates 4*a* and 4*b*, the side plate 4*a* located close to a printing start position is designated a printing start side plate 4*a*, while the side plate 4*b* located close to a printing end position is designated a printing end side plate 4*b*.

On the platen 6 side nearly centrally in the moving direction of the carriage 7 is disposed a head up-down lever 8 for performing the up-down motion of the thermal head 3, the lever 8 being supported pivotably about a pivot shaft 8*c*. A head mounting base 9 for mounting the thermal head 3 is secured to one end portion 8*a* of the head up-down lever 8 and the thermal head 3, which has heat generating elements (not shown), is secured to a side face 9*a* on the platen 6 side of the head mounting base 9.

At the one end portion 8*a* of the head up-down lever 8 and at a position close to a side face 9*b* of the head mounting base 9 on the side opposite to the platen 6 there is projectingly provided a support plate 11 for holding one end face of an urging spring 12 as an urging member. In the support plate 11 is formed a fitting hole (not shown), in which one end face of the urging spring 12 is fitted.

A coiled spring is most suitable as the urging spring 12, provided it may be substituted by another resilient member or the like insofar as the resilient member can urge the thermal head 3 toward the platen 6.

A spring supporting projection 13 for supporting an opposite end face of the urging spring 12 is formed at an end portion 7*a* on the printing start side of the carriage 7.

Therefore, the head up-down lever 8 is always given an urging force by the urging spring 12 in a direction to bring the thermal head 3 into pressure contact with the platen 6.

At an end portion 8*b* of the head up-down lever 8 on the side with the thermal head 3 not attached thereto is formed a cam sliding portion 14 adapted to slide on the inclined cam surface 18 and flat cam surface 17 of a head up-down cam 15 which will be described later, the cam sliding portion 14 being formed in the shape of a curved surface. This curved surface permits the cam sliding portion 14 to slide smoothly on the inclined cam surface 18 and the flat cam surface 17.

A head up-down cam 15 for pivotally moving the head up-down lever 8 is held by the carriage 7 slidably in the reciprocating direction of the carriage. Both end portions 15*a* and 15*b* of the head up-down cam 15 are projected from both-side ends 7*a* and 7*b* of the carriage 7 and are adapted to come into abutment respectively with the side plates 4*a* and 4*b* before the start of printing or after the end of one-line printing with movement of the carriage.

After abutment against each side plate 4*a* (4*b*) with the reciprocating motion of the carriage 7, the head up-down cam 15 moves in the direction opposite to the moving direction of the carriage 7.

At the end portion 15*b* on the printing end side of the head up-down cam 15 is formed a flat cam surface 17 for keeping the thermal head 3 spaced apart from the platen 6, the flat cam surface 17 being approximately parallel to the platen. Further, an inclined cam surface 18 for change-over between a contacting motion and a leaving motion of the thermal head 3 with respect to the platen 3 is formed inclinedly from an inner edge portion of the flat cam surface 17 in a direction in which it leaves the platen 6.

Thus, in the head up-down mechanism 2 of this embodiment, as shown in FIGS. 2 to 6, the head up-down motion of the thermal head 3 is changed over with movement of the carriage 7.

Figure 2:
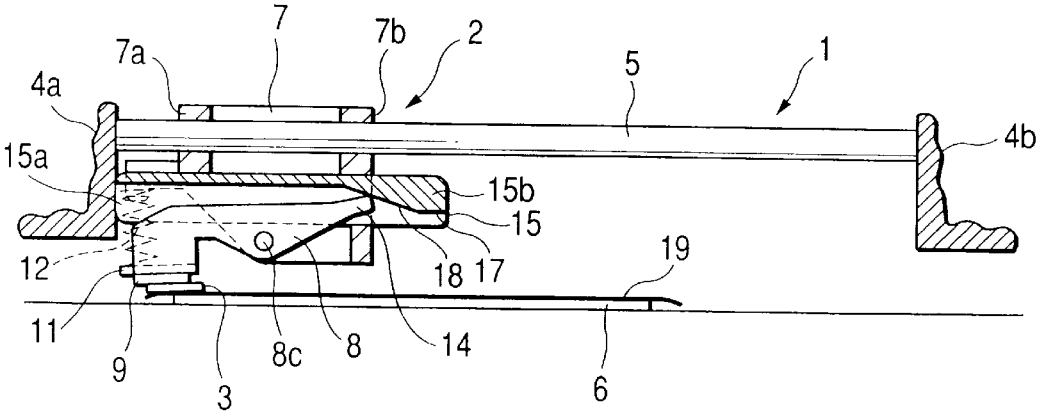
FIG. 2 is an explanatory view showing a head-down stand-by state of a thermal head used in the embodiment.

More particularly, as shown in FIG. 2, when the carriage 7 is in a head-down stand-by state, the end face 15*a* on the printing start position side of the head up-down cam 15 is in abutment against the printing start side plate 4*a* and is located completely on the printing direction side of the carriage 7, while the cam sliding portion 14 of the head up-down lever 8 is positioned below the inclined cam surface 18, with the thermal head 3 being in pressure contact with the platen 6 and thus assuming a head-down state.

Figure 3:
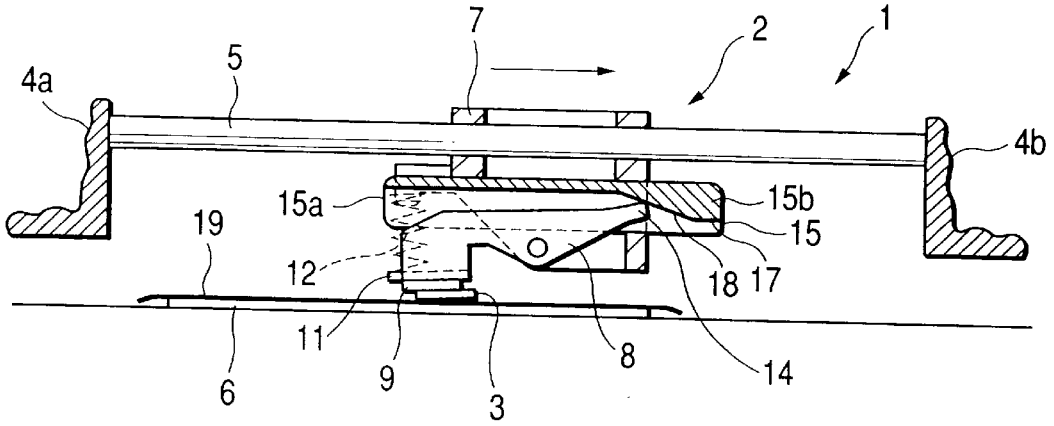
FIG. 3 is an explanatory view showing a head-down printing state of the thermal head in the embodiment.

In this head-down state, as shown in FIG. 3, the carriage 7 is moved in the printing direction along the carriage guide shaft 5 by a drive means such as a drive motor or a drive belt (neither shown) and a desired printing is performed by the thermal head 3.

Figure 4:
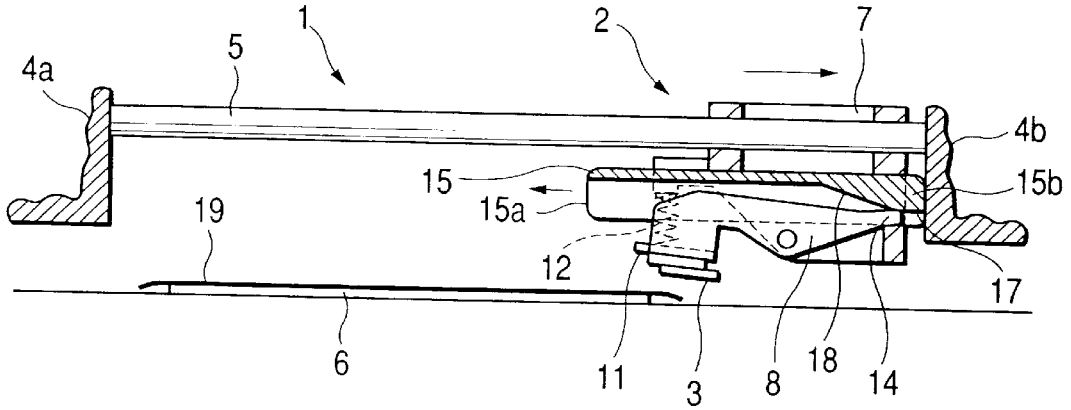
FIG. 4 is an explanatory view showing a head-up stand-by state of the thermal head in the embodiment.

Further, even after completion of the printing, the carriage 7 is then moved in the printing direction and, as shown in FIG. 4, the end face l5*b* on the printing end side of the head up-down cam 15 is brought into abutment against the printing end side plate 4*b* and the cam 15 is thereby moved in the direction opposite to the moving direction of the carriage 7, so that the cam sliding portion 14 of the head up-down lever 8 is allowed to slide up onto the inclined cam surface 18 and comes into sliding contact with the flat cam surface 17.

As a result, the head up-down lever 8 is pivotally moved clockwise in FIG. 4 against the urging force of the urging spring 12 and therefore the thermal head 3 is held in the head-up state in which it is spaced apart from the platen 6.

Figure 5:
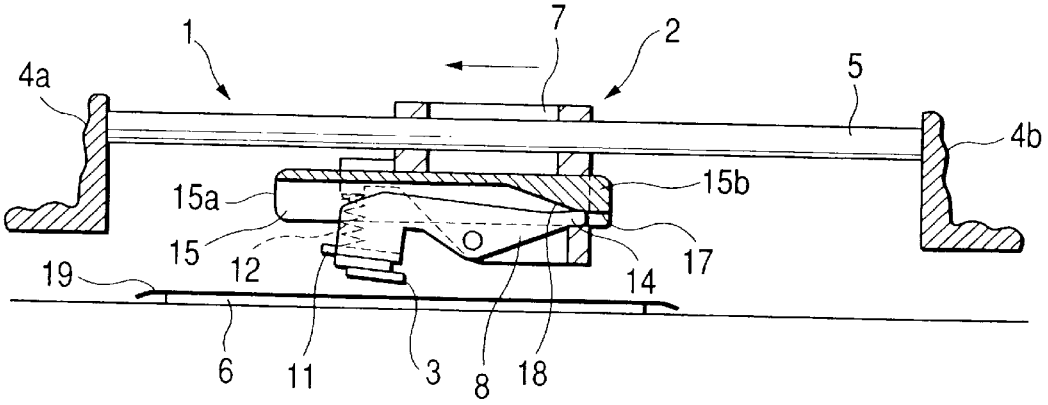
FIG. 5 is an explanatory view showing a head-up return state of the thermal head in the embodiment.
Figure 6:
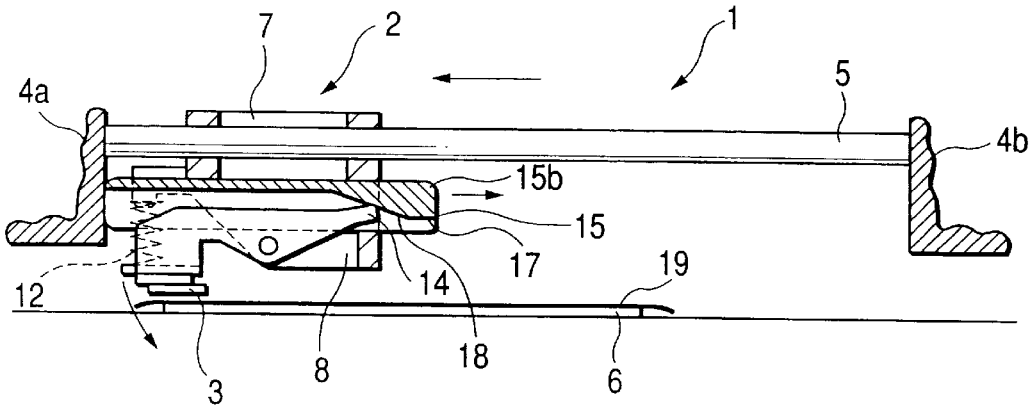
FIG. 6 is an explanatory view showing a head-down return state of the thermal head in the embodiment.
Figure 7:
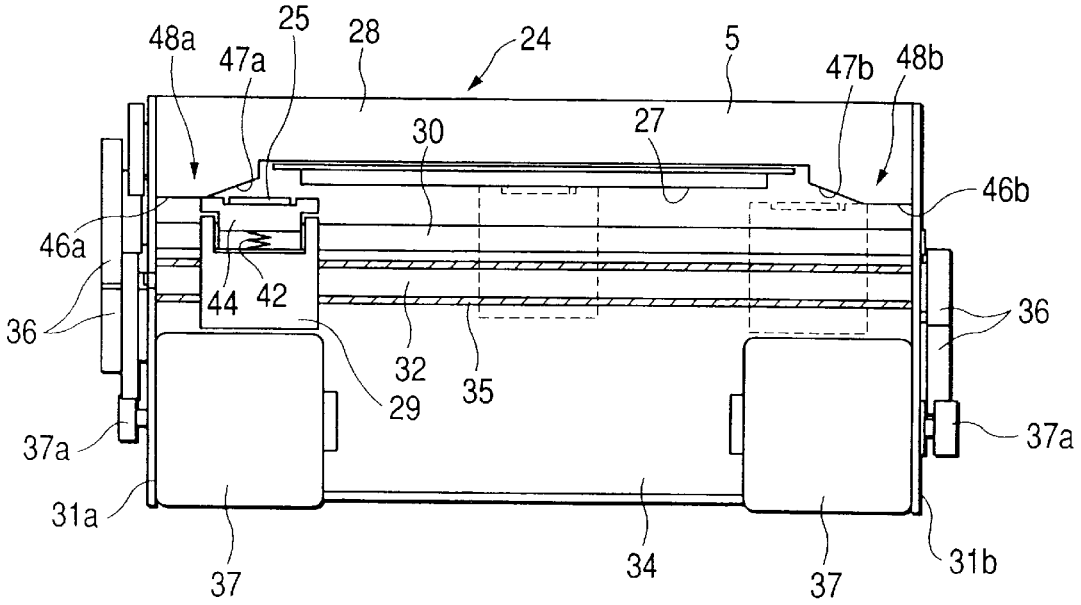
FIG. 7 PRIOR ART
FIG. 7 is a plan view showing a conventional thermal printer.
Figure 8:
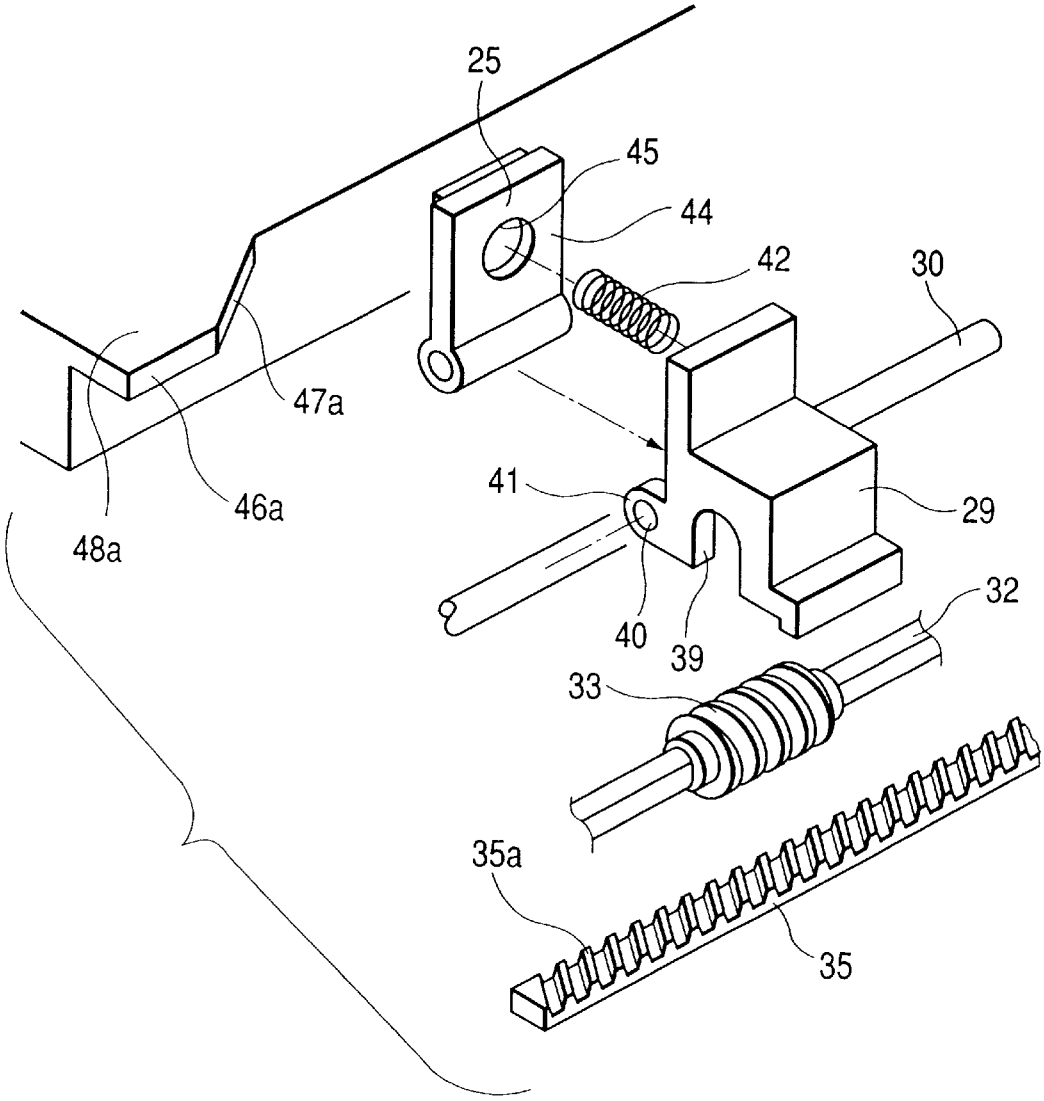
FIG. 8 PRIOR ART
FIG. 8 is an exploded perspective view showing a construction in the vicinity of a carriage used in the conventional thermal printer.

Then, as shown in FIG. 5, when the carriage 7 is returned (at the time of carriage return) toward the printing start position in the head-up state of the thermal head, printing paper 19 is fed by means of a paper feed mechanism (not shown)such as paper feed rollers. The feed of the printing paper 19 is completed until return of the carriage 7 to the printing start position.

Next, as shown in FIG. 5, from before the carriage 7 is completely located at the printing start position, the end face 15*a* on the printing start side of the head up-down cam 15 is brought into abutment against the printing start side plate 4*a* and the cam 15 moves in the direction opposite to the return direction of the carriage 7, while the cam sliding portion 14 of the head up-down lever 8 slides downward along the inclined cam surface 18.

Consequently, with the urging force of the urging spring 12, the head up-down lever 8 is pivotally moved little by little while following the inclination of the inclined cam surface 18, and the thermal head 3 assumes the head-down state. In this state, the preparation for the next line printing is completed.

The operation of this embodiment will be described below.

According to the head up-down mechanism 2 of the thermal printer 1 in this embodiment, when the carriage 7 is in the printing start position, the printing start-side end face 15*a* of the head up-down cam 15 is brought into abutment against the printing start side plate 4*a*, causing the cam 15 to move in the printing end direction (rightward in FIG. 2), while the cam sliding portion 14 of the head up-down lever 8 is positioned below the inclined cam surface 18.

Therefore, the head up-down lever 8 causes the thermal head 3 to be in pressure contact with the platen 6 with the urging force of the urging spring 12.

In this head-down state, the heat generating elements of the thermal head 3 are allowed to generate heat selectively while the carriage 7 is moved in the printing direction, to effect a desired printing on the printing paper 19.

Then, when one-line printing is completed by the thermal head 3, the carriage 7 moves in the printing direction before return to the printing start position and causes the end face 15*b* on the printing end side of the head up-down cam 15 to abut the printing end side plate 4*b*, allowing the cam 15 to move in the direction opposite to the moving direction of the carriage 7.

At this time, the cam sliding portion 14 of the head up-down lever 8 goes up on the inclined cam surface 18 and reaches a position on the flat cam surface 17, the lever 8 turns against the urging force of the urging spring 12 and causes the thermal head 3 to be spaced apart from the platen 6. Thus, the thermal head 3 assumes its head-up state.

Upon completion of the head-up state, the carriage 7 is moved in the direction of return to the printing start position (carriage return) and at the same time the feed of printing paper 19 is performed using paper feed rollers (not shown) or the like.

Before the carriage 7 arrives at the printing start position, the end face 15*a* on the printing start side of the head up-down cam 15 comes into abutment against the printing start side plate 4*a*, whereby the cam 15 is moved in the direction opposite to the moving direction of the carriage 7.

As a result, the cam sliding portion 14 of the head up-down lever 8 slides on the flat cam surface 17, then slides down on the inclined cam surface 18 and causes the head up-down lever 8 to turn against the urging force of the urging spring 12, allowing the thermal head 3 to assume its head-down state.

From this head-down state the carriage 7 is moved in the printing direction to print the next line.

The above printing by the thermal head 3, feed of printing paper 19 and carriage return motion are repeated to complete printing for the whole of printing paper 19.

Thus, according to the above embodiment of the present invention, by a simple operation that the head up-down cam is moved by reciprocation of the carriage 7, not only it is possible to return the carriage 7 up to the printing start position (carriage return) while the thermal head 3 is kept spaced (head-up) away from the platen 6, but also it is possible to effect the paper feed operation. Consequently, it is possible to improve the effective printing speed.

The present invention is not limited to the above embodiment, but modifications may be made as necessary.

In the head up-down mechanism of the printer according to the present invention, as set forth above, the carriage can be returned up to the printing start position while the thermal head is kept spaced apart from the platen, and at the same time it is possible to perform the paper feed operation. Therefore, the effective printing speed can be improved.

What is claimed is:

1. A head up-down mechanism in a printer, comprising:

a carriage capable of reciprocating along a platen between both side plates which are spaced a predetermined distance from each other;

a head up-down lever supported pivotably by said carriage and with a thermal head mounted thereon at a position opposed to said platen;

an urging member for urging said head up-down lever in a direction in which said thermal head comes into abutment against said platen; and a head up-down cam which is moved by abutment thereof against each of said side plates and which causes said head up-down lever to turn so that said thermal head comes into or out of contact with said platen.

2. A head up-down mechanism in a printer according to claim 1, wherein said head up-down cam is brought into abutment against each of said side plates with a reciprocating motion of said carriage and is thereby moved in a direction opposite to the moving direction of the carriage.

3. A head up-down mechanism in a printer according to claim 1, wherein said head up-down cam is formed with an inclined cam surface for change-over between a contacting motion and a leaving motion of said thermal head with respect to said platen and a flat cam surface for maintaining a state in which the thermal head is spaced apart from the platen.

4. A head up-down mechanism in a printer according to claim 1, wherein said head up-down lever is formed with a cam sliding portion adapted to slide on said inclined cam surface and said flat cam surface.

* * * * *